United States Patent [19]

Re

[11] 3,941,417

[45] Mar. 2, 1976

[54] RECLINING CHAIR

[75] Inventor: Frank M. Ré, Holyoke, Mass.

[73] Assignee: Dual Manufacturing and Engineering Incorporated, Holyoke, Mass.

[22] Filed: Jan. 20, 1975

[21] Appl. No.: 542,519

Related U.S. Application Data

[63] Continuation-in-part of Ser. No. 307,176, Nov. 16, 1972.

[52] U.S. Cl. ..... 297/85; 297/322

[51] Int. Cl.[2] ..... A47C 1/02

[58] Field of Search ..... 297/68, 281, 88, 83, 84, 297/85, 86, 87, 329, 281, 322, 282, 342, 316, 317, 318; 5/108, 47, 124, 127; 248/424, 421

[56] References Cited

UNITED STATES PATENTS

| | | | |
|---|---|---|---|
| 702,959 | 6/1902 | Jones | 5/47 |
| 2,092,787 | 9/1937 | Thomas | 248/424 X |
| 2,256,004 | 9/1941 | Thomas | 248/424 X |
| 2,270,172 | 1/1942 | Ruegger | 297/329 |
| 2,492,106 | 12/1949 | Orton | 297/318 |
| 2,725,921 | 12/1955 | Markin | 297/318 X |
| 2,815,794 | 12/1957 | Hendrickson et al. | 297/342 |
| 3,047,334 | 7/1962 | Vanderminden | 297/281 X |
| 3,191,990 | 6/1965 | Rugg et al. | 297/316 X |
| 3,343,871 | 9/1967 | Yates et al. | 297/330 X |
| 3,493,264 | 2/1970 | Ré | 297/DIG. 7 |

OTHER PUBLICATIONS

Experimental Mechanics, by Fred Collins, Published by Appleton & Co., N.Y., N.Y., 1931, p. 39.

*Primary Examiner*—James T. McCall
*Attorney, Agent, or Firm*—Ross, Ross & Flavin

[57] ABSTRACT

A reclining chair positionable in close adjacency to a room wall in an upright sitting position and allowing ready assumption of any of a variety of reclining positions without physical contact of any chair component with that room wall. The chair envisions a fixed base, a chassis movable linearly relative to the base, and a body-support movable between the sitting/retracted and reclining/extended positions relative to the chassis, a first system of links operatively connecting between the base and chassis and body-support for effecting linear movement of the chassis relative to the base, and a second system of links connecting between the first system of links and the base and chassis and body-support unit for effecting reclining movement of the body-supporting unit relative to the chassis, said base, chassis, body-support and systems of links constituting kinematically speaking, but a single mechanism. The movements of the link systems are so coordinated that the chassis moves progressively forwardly away from the room wall as transition is made from upright sitting position to progressive reclining positions to the end that the body supporting unit is concurrently moved forwardly away from the room wall. Reversely, with the chassis moving rearwardly and progressively toward the room wall as transition is made from progressive reclining positions to upright sitting position, the body-supporting unit is concurrently moved rearwardly and toward the room wall.

5 Claims, 14 Drawing Figures

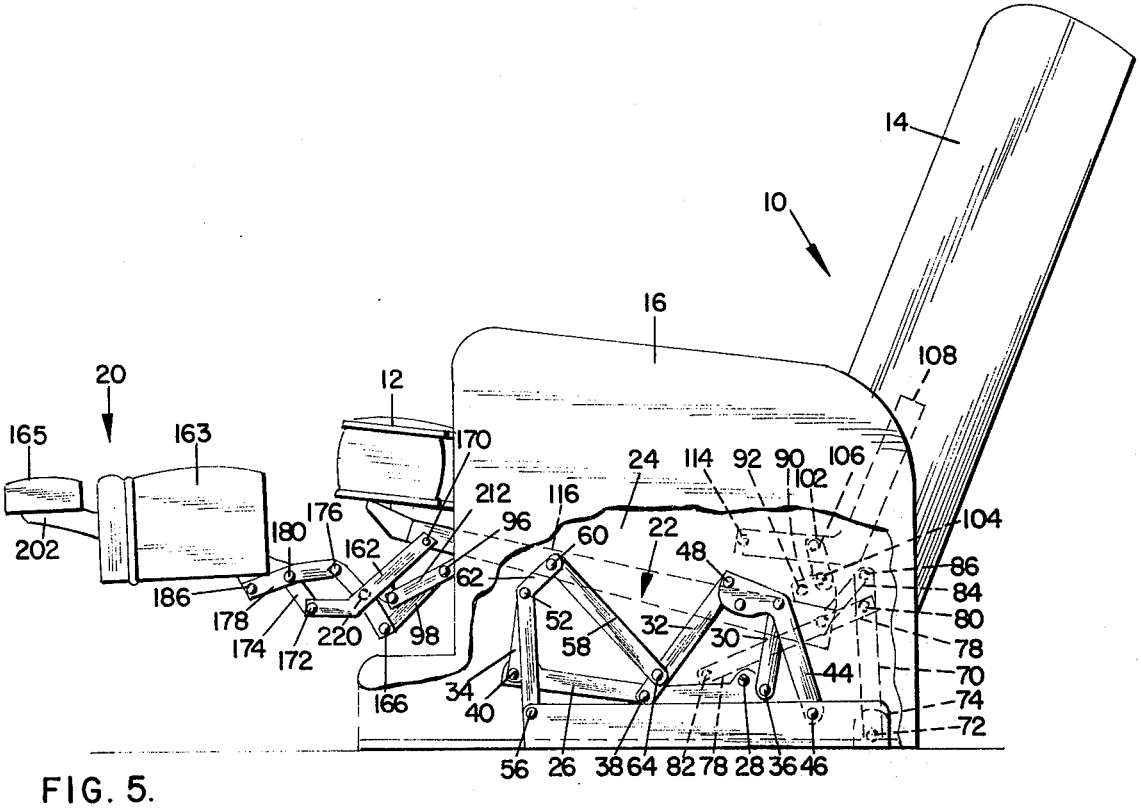
FIG. 5.
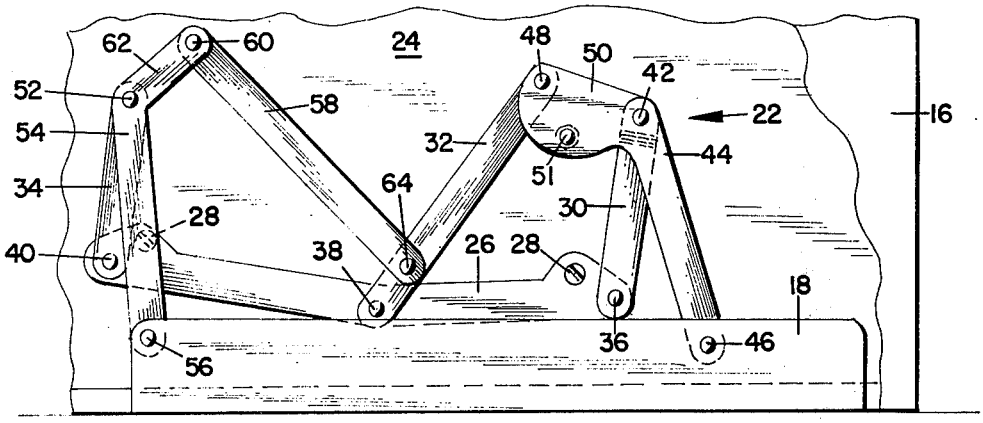
FIG. 7.
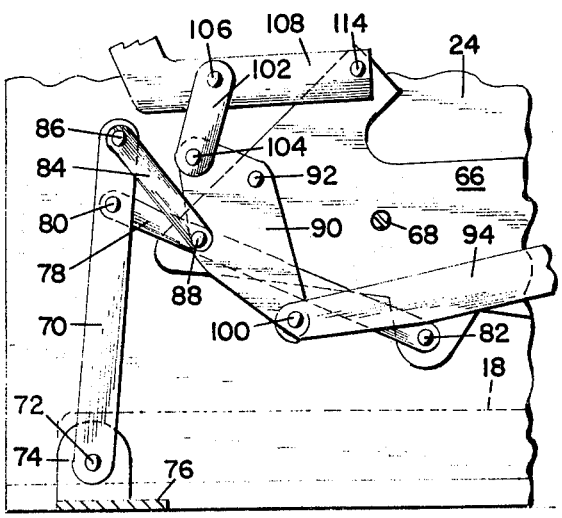
FIG.8.
FIG.9.
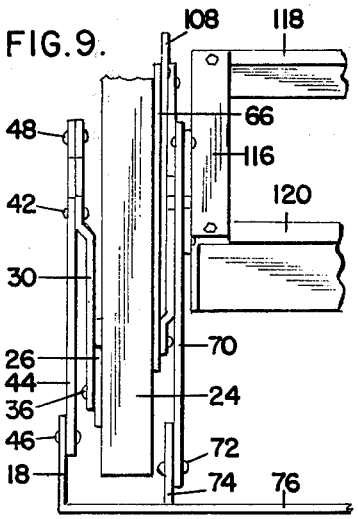

RECLINING CHAIR

This is a continuation-in-part of my copending application Ser. No. 307,176 filed Nov. 16, 1972.

The invention teaches a reclining chair which can be positioned in close adjacency to a wall or to any article of furniture without touching same while assuming or maintaining any of its plurality of positions.

The chair chassis is moved forwardly away from the wall as the chair body-support is reclined, thereby permitting the chair back to be placed in close proximity to the wall.

This is accomplished by a novel arrangement of interconnected linkage systems for effecting linear travel of the chassis relative to the base concomitant with shifting movement of the body-support relative to the chassis.

In the drawings:

FIG. 5 is a view similar to FIG. 4, the chair being shown in intermediate reclined or TV-position;

FIG. 7 is an enlarged, fragmentary, side elevational view of a portion of the linear movement mechanism;

FIG. 8 is an enlarged, fragmentary, side elevational view of another portion of the linear movement mechanism and a portion of the reclining movement mechanism, with the chair seat and certain other components omitted for clarity;

FIG. 9 is a fragmentary, rear elevational view of the mechanisms of FIGS. 7 and 8, as viewed from the left of FIG. 8, and including the chair seat;

THE CHAIR IN GENERAL

Figure 1:
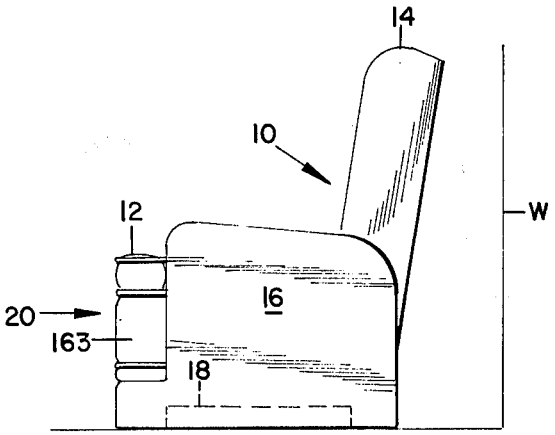
FIGS. 1 – 3 are somewhat diagrammatic side elevational views showing the chair and its relationship to a room wall or other upright surface as the chair is moved between upright sitting position, intermediate reclined or TV-position, and fully reclined position, respectively.
Figure 2:
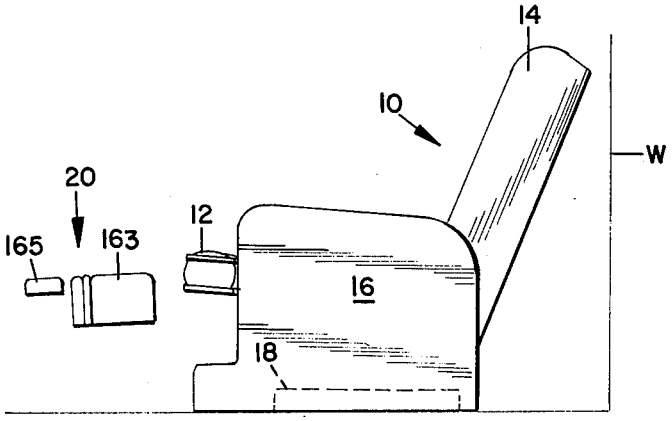
Figure 3:
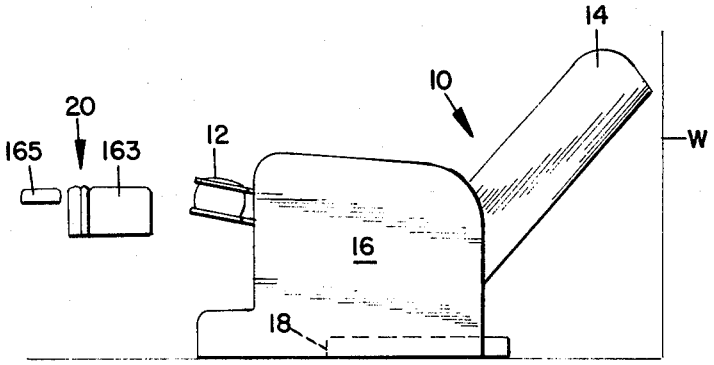
Figure 4:
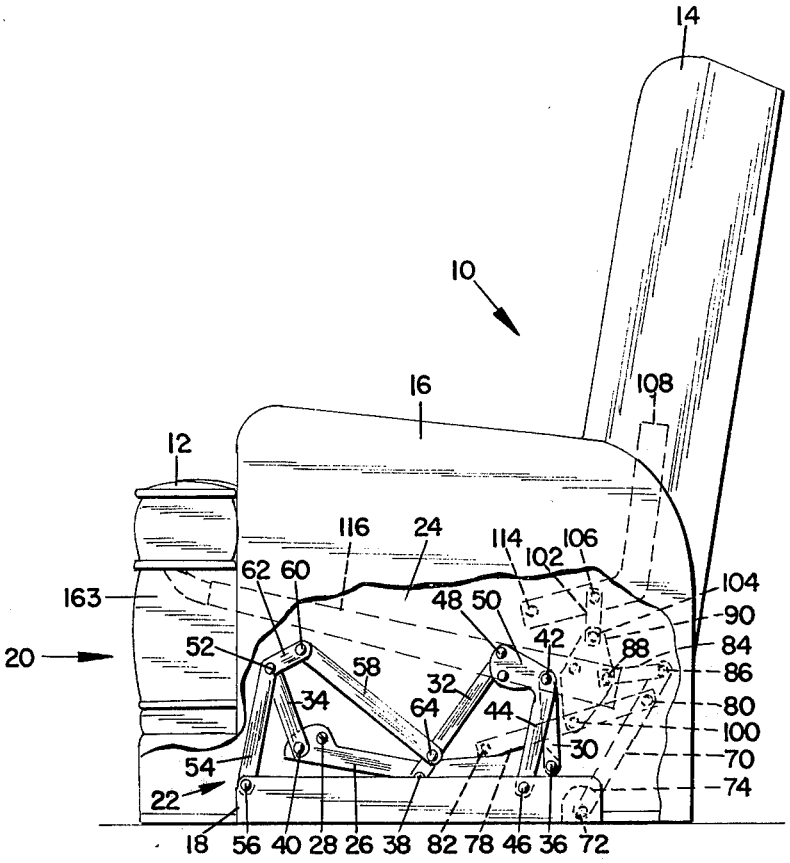
FIG. 4 is a side elevational view of the chair in upright or sitting position with portions of the side wall broken away.

As seen in FIGS. 1 – 3, the chair of the invention is adapted to be positioned in close proximity to a wall W or other surface, with the chassis moving linearly away from the wall to provide a necessary clearance for the body-supporting unit as the body-supporting unit is moved between upright or sitting/retracted position, intermediate-reclined/extended or TV-position and fully-reclined/extended position.

The chair generally comprises a body-support 10 including a seat 12 and backrest 14 pivotal relative to each other and relative to a chassis 16 which is movable linearly relative to a stationary base 18, and a legrest 20 which is movable between retracted and extended positions in concert with movement of the body-support.

A one-part legrest could easily be employed in lieu of the two-part legrest as shown.

It will also be understood, that the linkages hereinafter to be described constitute two pairs, with one pair being located at each side of the chair. Kinematically, the assembly of linkages and chair components constitute but a single mechanism.

Since the pairs of linkages are mirror images at each side of the chair, only one such pair will be described.

THE LINEAR MOVEMENT SUBASSEMBLY

The linear movement subassembly is generally indicated by 22 and is mounted for pivotal, swinging movement relative to base 18 for effecting linear travel of chassis 16.

A side wall 24 of chassis 16 is considered to be part of the linear movement subassembly and will be referred to hereinafter as chassis link 24.

A first mounting link 26 which extends front-to-rear is fixed to the outer planar face of chassis link 24 as by screws 28.

A trio of pivot links is pivoted to mounting link 26 and includes primary, secondary and tertiary pivot links 30, 32, and 34 respectively. Primary pivot link 30 is pivoted at its lower end at 36 to the rearward end of link 26; secondary pivot link 32 is pivoted at its lower end at 38 to the approximate midsection of link 26; and tertiary pivot link 34 is pivoted at its lower end at 40 to the forward end of link 26.

The upper end of primary pivot link 30 is pivotally connected at 42 to the upper end of a first base link 44 which is pivoted at its lower end at 46 to base 18 adjacent the rearward end of the latter.

The upper end of secondary pivot link 32 is pivotally connected at 48 to an extension 50 of first base link 44.

Tertiary pivot link 34 is pivotally connected at its upper end at 52 to the approximate midsection of a second base link 54 which is pivoted at its lower end at 56 to base 18 adjacent the forward end of the latter.

A connecting link 58 is pivoted at its upper end at 60 to an extension 62 of second base link 54 and is pivoted at its lower end at 64 to secondary pivot link 32.

A stop 51 extends inwardly from extension 50 of first base link 44 and is adapted to contact the rear edge of secondary pivot link 32 to define the chair upright position.

The linear movement subassembly additionally includes certain components located adjacent the inner planar face of chassis link 24 between the chassis link and body-support 10.

Figure 10:
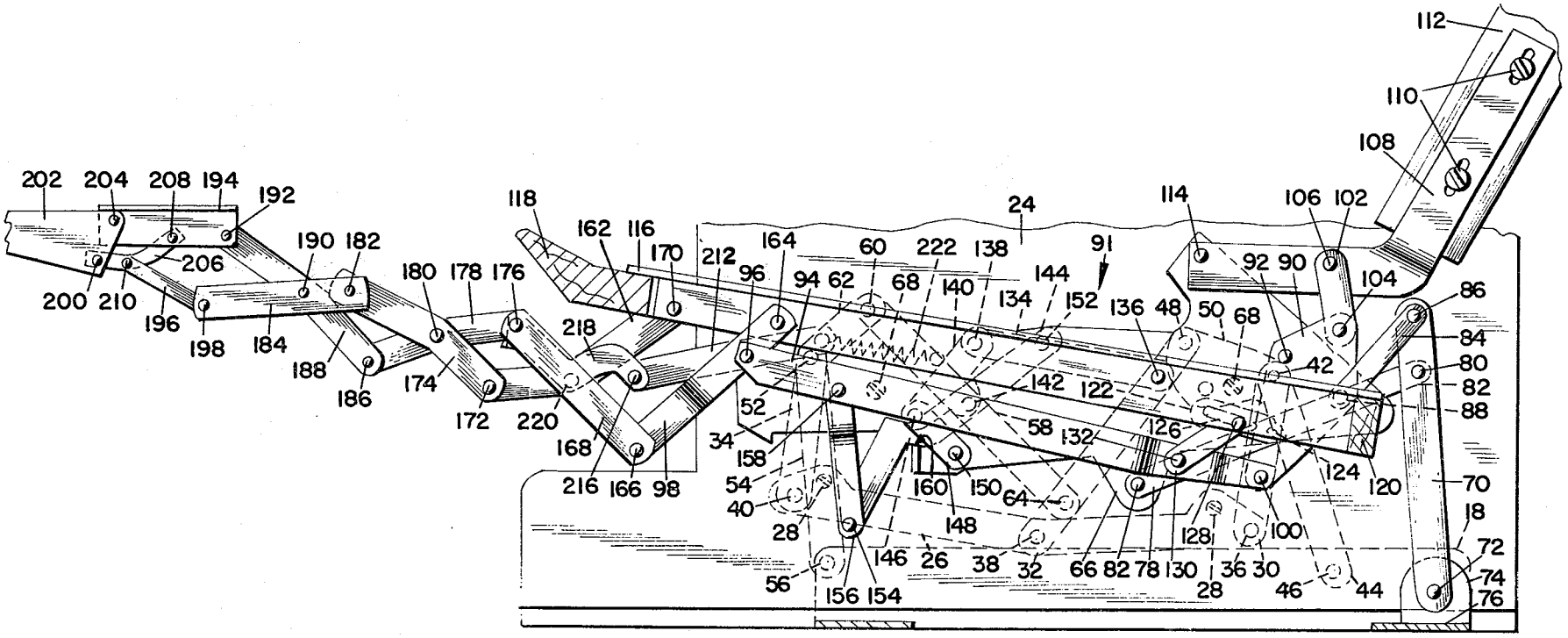
FIG. 10 is an enlarged, fragmentary, longitudinal sectional view taken along the chair front-to-rear axis with the chair seat cushion, back-rest cushion and leg rest cushion removed for clarity, the chair being shown in the intermediate reclined or TV-position.

As best seen in FIGS. 8 and 10, these components include a second mounting link 66 which extends front-to-rear, and is fixed to the inner planar face of chassis link 24 as by screws 68.

A primary drive link 70 is pivoted at its lower end at 72 to a bracket 74 fixed to and extending upwardly from a rear cross rail 76 of base 18.

A secondary drive link 78 is pivoted at its upper end at 80 to primary drive link 70 and at its lower end at 82 to second mounting link 66.

A tertiary drive link 84 is pivoted at its upper end at 86 to primary drive link 70 and at its lower end at 88 to a control link 90 pivoted at 92 to second mounting link 66, the control link 90 serving as the focal point for connecting the linear movement subassembly and the reclining movement subassembly, as will appear.

Figure 12:
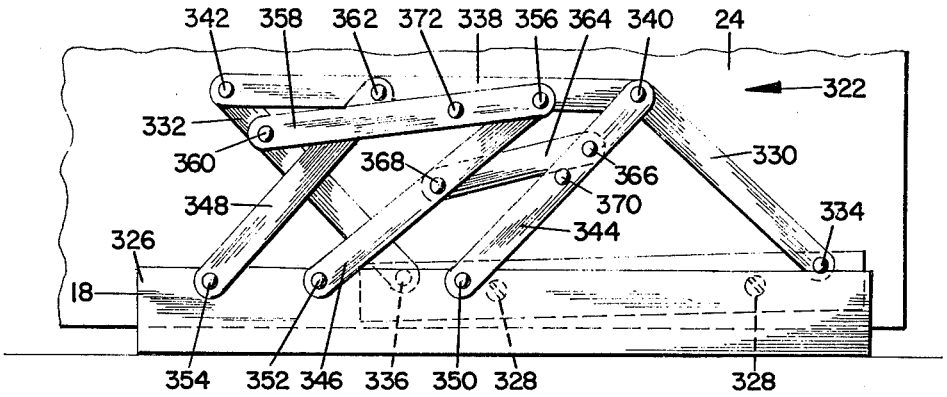
FIG. 12 is an enlarged, fragmentary side elevational view of a portion of a modified form of linear movement mechanism, the chair components being shown in an upright, sitting position.
Figure 13:
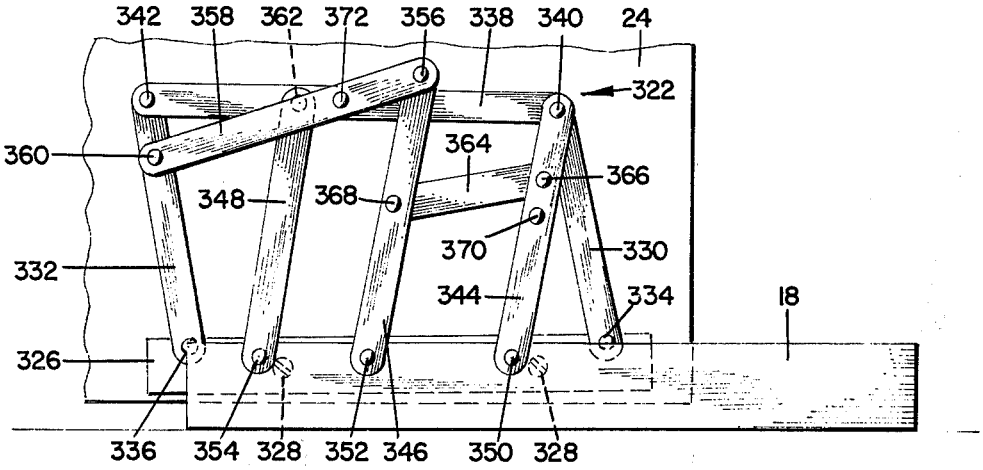
FIG. 13 is a view similar to FIG. 12, the chair components being shown in an intermediate reclined or TV position.
Figure 14:
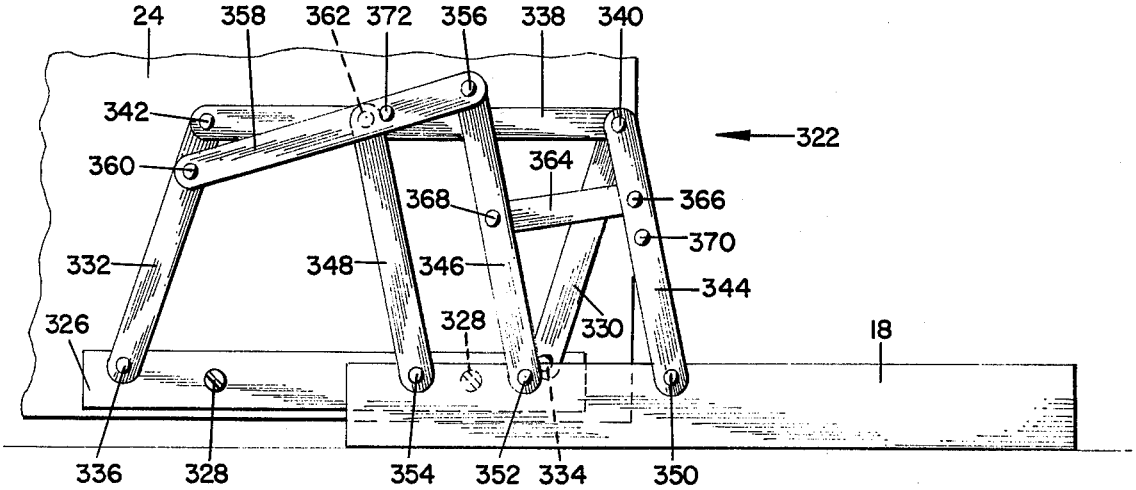
FIG. 14 is a view similar to FIG. 12, the chair components being shown in a fully reclined position.

A modified form of linear movement subassembly is shown in FIGS. 12 – 14 and is generally indicated by 322.

Linear movement subassembly 322 includes a first mounting link 326 which extends front-to-rear and is fixed to the outer planar face of chassis link 24 as by screws 328.

A pair of primary and secondary pivot links, 330 and 332 respectively, is pivoted to mounting link 326.

Primary pivot link 330 is pivoted at its lower end at 334 to the rearward end of mounting link 326, and secondary pivot link 332 is pivoted at its lower end at 336 to the forward end of mounting link 326.

A first cross link 338 extends between and connects the upper ends of pivot links 330 and 332, being pivoted at one end at 340 to the upper end of primary pivot link 330 and at its opposite end at 342 to the upper end of secondary pivot link 332.

A trio of base links is pivoted to base 18 and includes primary, secondary and tertiary base links 344, 346, and 348, respectively.

Primary base link 344 is pivoted at its lower end at 350 to base 18; secondary base link 346 is pivoted at its lower end at 352 to base 18 forwardly of the pivot 350; and tertiary base link 348 is pivoted at its lower end at 354 to base 18 forwardly of the pivot 352.

Primary base link 344 is pivoted at its upper end at the pivot 340 to the upper end of primary pivot link 330 and to the rearward end of first cross link 338.

Secondary base link 346 is pivoted at its upper end at 356 to the rearward end of a second cross link 358 which is pivoted at its forward end at 360 to secondary pivot link 332.

Tertiary base link 348 is pivoted at its upper end at 362 to the approximate midsection of first cross link 338.

A third cross link 364 is pivoted at its rearward end at 366 to the approximate midsection of primary base link 344 and is pivoted at its forward end at 368 to the approximate midsection of secondary base link 346.

A first stop 370 extends inwardly from primary base link 344 and is adapted to contact the lower edge of third cross link 364 to define the chair upright position.

A second stop 372 extends inwardly from second cross link 358 and is adapted to contact the rearward edge of tertiary base link 348 to define the chair fully reclined position.

THE RECLINING SUBASSEMBLY

Herefollowing, a specific subassembly for effecting reclining movement of the body-support will be described. However, it will be understood that a number of reclining subassemblies can be substituted therefor without departing from the scope of the invention.

The reclining subassembly, which is operatively connected to and operates in conjunction with the linear movement subassembly, is generally indicated by 91 and includes, in common with linear movement subassembly 22, second mounting link 66 and control link 90.

A rise bar 94, which extends front-to-rear is pivoted at its forward end at 96 to a primary actuator link 98 and at its rearward end at 100 to control link 90.

Control link 90 is operatively connected to back rest 14 by a short link 102 pivoted at its lower end at 104 to control link 90 and at its upper end at 106 to a generally L-shaped backrest link 108.

As best seen in FIG. 10, back rest link 108 is fixed as by screws 110 to a side rail 112 of the back rest and is pivoted at 114 at its forward end to second mounting link 66.

Figure 11:
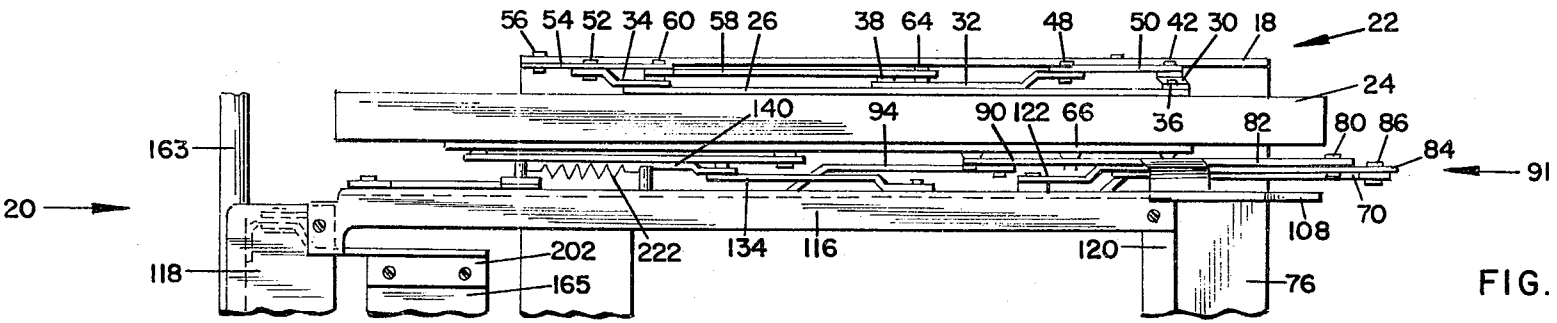
FIG. 11 is a top plan view of the FIG. 10 structure, with the components being shown in chair upright position.

A seat bracket 116, also extending front-to-rear of the chair, is stationarily secured to transversely-extending front and rear stretchers 118 and 120 respectively (see FIGS. 9 – 11), of seat 12.

Control link 90 is operatively connected to the seat by a system of links including a slotted link 122 pivoted at 124 at its lower end to control link 90 and having a central slot 126 therein in which a pin 128 provided on seat bracket 116 is slideable.

A connecting link 130 is pivoted at its upper end to pin 128 and at 132 at its lower end to rise bar 94, thereby effecting an operative connection between the seat and leg rest.

A system of links is provided for raising seat bracket 116 and moving it and seat 12 forwardly to clear the chair arms as the body-supporting unit is reclined while counter-balancing the chair back to preclude any objectionable falling sensation on the part of the chair occupant.

Said system of links includes a seat link 134 pivoted at 136 at its rearward end to seat bracket 116 and pivoted at 138 at its opposite end to the upper end of a pivot link 140.

Pivot link 140 is pivoted at 142 at its approximate midsection to the approximate midsection of a first connecting link 144 and is pivoted at 146 at its lower end to the upper end of a second connecting link 148 which is pivoted at 150 at its lower end to second mounting link 66.

First connecting link 144 is pivoted at its rearward end at 152 to second mounting link 66 and is pivoted at 154 at its forward end to the lower end of a third connecting link 156 which is pivoted at 158 at its upper end to rise bar 94.

In the chair upright and intermediate reclining positions, first connecting link 144 rests upon an offset flange 160 provided on second mounting link 66, this flange acting as a stop to preclude any drooping of the linkage mechanism.

The upper surface of control link 90 also functions as a stop when it is engaged with the lower surface of back rest link 108 to limit the degree of angularization of the back rest when the chair is in the fully reclined position.

The legrest 20 herein is suspended from seat 12 and is of the two-part foldaway type having interconnected major and minor leg rest parts, 163 and 165 respectively.

As aforesaid, a one-part legrest can also be employed.

The legrest is operatively connected to and operates in conjunction with the reclining subassembly, with the legrest being mounted relative to the forward end of seat 12 for movement between a fully-retracted position and a fully-extended position.

In the fully-retracted position, which is the upright or sitting position, major leg rest part 163 is positioned substantially flush with the forwardly facing front edge of the seat, while cooperant minor leg rest part 165 is positioned so as to extend rearwardly from the lower end of the major part and to be concealed from view beneath the seat.

When the major leg rest part is elevated and advanced to any extended position, cooperant minor leg rest part is moved accordingly therewith, it being pivotally connected thereto. When the major leg rest part is in fully-extended position, the minor leg rest part will have moved to a position forwardly thereof and in axial alignment therewith.

Leg rest 20 is suspended relative to seat 12 by a pair of actuator links, namely: primary actuator link 98 and a secondary actuator link 162.

Primary actuator link 98 is pivoted at its upper end at 164 to seat bracket 116 and at its lower end at 166 to the lower end of a primary legrest drive link 168.

Secondary actuator link 162 is pivoted at its upper end at 170 to seat bracket 116 and at its lower end at 172 to the lower end of a secondary legrest drive link 174.

Primary legrest drive link 168 is pivoted at its upper end at 176 to the rear end of a primary legrest propeller link 178 which is pivoted at 180 at its approximate midsection to the approximate midsection of secondary legrest drive link 174 which is pivoted at its upper end at 182 to the rearward end of a secondary legrest propeller link 184.

Primary legrest propeller link 178 is pivoted at 186 at its forward end to the lower end of a major leg rest drive link 188 which is pivoted at 190 at its approximate midsection to the approximate midsection of secondary legrest propeller link 184 and at its upper end at 192 to one end of a major leg rest support plate 194.

The forward end of secondary legrest drive link 174 is provided with a stop surface which is adapted to contact a stop surface on major leg rest drive link 188 to limit the range of extension of the leg rest.

A minor leg rest drive link 196 is pivoted at 198 at its lower end to the forward end of secondary legrest propeller link 184 and is pivoted at 200 at its upper end to a minor leg rest support plate 202 which is pivoted to major leg rest support plate 194 at 204.

A connecting link 206 is pivoted at 208 at its upper end to major leg rest support plate 194 and at its lower end at 210 to minor leg rest drive link 196 adjacent the forward end of the latter.

Means is provided for controlling the movement of the leg rest and comprises a primary control link 212 pivoted at 96 adjacent one of its ends to primary actuator link 98 and to the forward end of rise bar 94, and pivoted at 216 at its opposite end to the rearward end of a secondary control link 218, which is pivoted at 220 at its approximate midsection to the approximate midsection of secondary actuator link 162 and is pivoted at its forward end at the pivot 176 to the rearward end of primary legrest propeller link 178 and the forward end of primary legrest drive link 168.

Primary control link 212 is spring-loaded by a tension spring 222 fixed at one end to the inner free end of control link 212 and fixed to its opposite end to seat bracket 116.

The control means controls the speed and manner of movement of the leg rest, while the spring loading of primary control link 212 ensures that the leg rest remains closed while the chair is upright.

THE INTERREACTION OF THE SUBASSEMBLIES REQUISITE FOR SUCCESSFUL CHAIR OPERATION

The body-support 10 is motivated to reclined position by the chair occupant by exerting a rearward pressure on backrest 14 and a forward pressure on the chair arms or upper surface of chassis 16 whereupon the seat and backrest shift relative to the chassis to assume the intermediate reclined or TV position shown in FIGS. 2 and 5, with the legrest extended.

During the transition from upright to intermediate position, drive links 70, 78 and 84 exert a forwardly directed force on the chassis, whereupon the linear travel subassembly 22 or 322 is activated and swings relative to base 18 to move the chassis forwardly, the body-support and legrest moving therewith.

Figure 6:
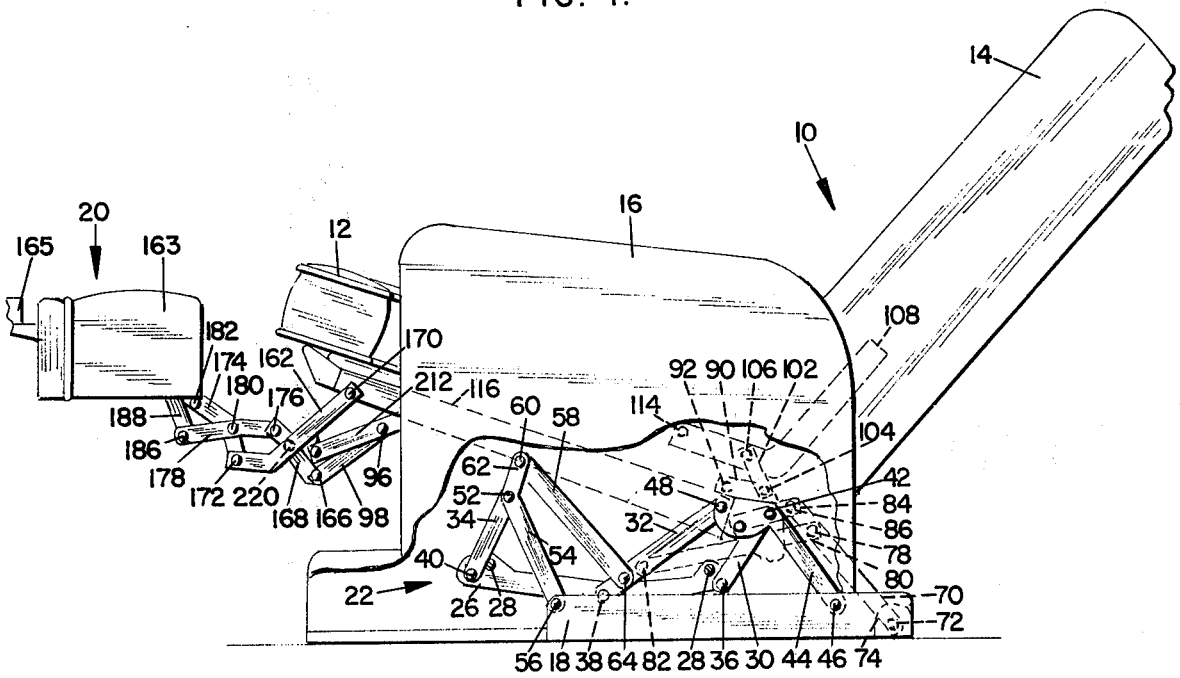
FIG. 6 is a view similar to FIG. 4, the chair being shown in fully reclined position.

Continued rearward pressure on the chair back and forward pressure on the chair arms moves the chair to the fully reclined position shown in FIGS. 3 and 6, with the drive links 70, 78 and 84 continuing to exert a forwardly directed force on the chassis and the linear travel subassembly swinging relative to base 18 to move the chassis, body-support and legrest forwardly.

To return the chair from the fully reclined position to the intermediate reclined or upright position, the chair occupant need only lean slightly forwardly to remove any rearward force from the backrest, and exert a downward force on the legrest with his heels whereupon the linear movement subassembly and reclining subassembly move in the opposite or rearward direction.

Regardless of the direction of linear travel, the subassemblies operate in concert, with the control link 90 being common to both the linear movement subassembly and the reclining subassembly.

I claim:

1. A reclining chair adapted to be positioned in close adjacency to and forwardly of a room wall when in the upright sitting position and yet so structured as to allow ready assumption of a reclined position without physical contact with the same room wall, the reclining chair comprising:

a base, a chassis supported relative to the base, a body-support including a seat and backrest, a reclining linkage subassembly for mounting the body-support relative to the chassis in movements between upright and reclining positions, a linear movement linkage subassembly for mounting the chassis relative to the base in linear movements relative to the base as the body-support is concomitantly moved, means for operatively connecting the reclining linkage subassembly and linear movement linkage subassembly wherefore the chassis moves forwardly and progressively away from the wall and the body-support relative to the wall as transition is made from upright sitting position toward a position of reclination and the chassis moves rearwardly and progressively toward the wall and the body-support relative to the wall as transition is made from a position of reclination toward upright sitting position, with the base, chassis, body-support, reclining linkage subassembly and linear movement linkage subassembly constituting kinematically but a single mechanism.

2. An occupant-operated living room type reclining chair positionable anywhere on a floor of a room free of attachment to the floor and in close adjacency to and forwardly of an object when in upright sitting position and yet so constructed as to allow ready assumption of any reclined position free of physical contact with the same object and comprising:

a base resting on the floor, free of permanent attachment to the floor, a chassis supported relative to the base, a body-supporting subassembly including a seat and backrest, a leg-supporting subassembly, control means for controlling the pivotal movements of the back relative to the seat, and pairs of linkage subassemblies operatively connected to each other and operatively-interconnecting the body-supporting subassembly and chassis and base and leg-supporting subassembly for, first, concurrently moving:

a. the body-supporting subassembly forwardly relative to the chassis, and b. the chassis relative to the base and progressively forwardly away from the object, as transition is made from upright sitting position to a position of reclination by the occupant leaning backwardly against the back and exerting a forwardly-pushing force against the chassis, and for, second, concurrently moving:

a. the body-supporting subassembly and leg-supporting subassembly rearwardly relative to the chassis, and b. the chassis relative to the base and progressively rearwardly toward the object, as transition is made from a position of reclination to upright sitting position by the occupant leaning forwardly away from the back and exerting a downwardly-pushing force against the leg-supporting subassembly.

3. A reclining chair movable by the occupant between upright sitting and intermediate-television and fully-reclined positions and positionable anywhere on a floor of a room and free of attachment to the floor and in close adjacency to a wall or object when in upright sitting position and yet so structured as to allow ready assumption of intermediate-television and fully-reclined positions free of contact with the wall or object comprising: a base, a chassis, a body-supporting subassembly including a seat and back having a pivotal relationship as to each other, a leg-supporting subassembly, a reclining linkage subassembly for controlling the pivotal movements of the seat relative to the back of the body-supporting subassembly and for effecting movement of the body-supporting subassembly between upright and intermediate and reclined positions concomitant with movement of the leg-supporting subassembly between retracted and extended positions respectively, and a linear movement subassembly operatively connected to the reclining linkage mechanism for effecting movement linkage of both the chassis and body-supporting subassembly relative to the base responsively to and simultaneously with movement of the body-supporting subassembly relative to the chassis.

4. A reclining chair adapted to be movable on a floor of a room and into close adjacency to and forwardly of an object when in upright sitting position and yet so structured as to allow ready assumption of a reclining position free of physical contact with the same object, the reclining chair comprising: a base, a chassis supported relative to the base, a body-supporting unit including a seat and back and leg-support having pivotal relationships as to each other, interconnected reclining and linear movement linkage subassemblies for controlling the pivotal movements of the seat relative to the back of the body-supporting unit and for operatively-interconnecting the body-supporting unit and chassis and base and leg-support for concurrently moving the chassis relative to the base forwardly and progressively away from the object and the body-supporting unit forwardly relative to the chassis and the leg-support from retracted to an extended position as transition is made from upright sitting to reclination positions and for concurrently moving the chassis relative to the base rearwardly and progressively toward the object and the body-supporting unit rearwardly relative to the chassis and the leg-support of the body-supporting unit from an extended to retracted position as transition is made from reclination to upright sitting positions.

5. A reclining chair adapted to be positioned on a floor more particularly in close adjacency to and forwardly of an object when in upright sitting position and yet so structured as to allow ready assumption of a reclining position without physical contact with the same object, the reclining chair comprising:

a base, a chassis supported relative to the base, a seat and a back having a pivotal relationship as to each other, a legrest, a linear movement linkage subassembly disposed between and fixed to the chassis and base, a reclining linkage subassembly for controlling the pivotal movements of the seat relative to the back and operatively-interconnected to the linear movement linkage subassembly, the seat and back, and legrest and chassis and base for concurrently propelling the chassis relative to the base and forwardly and progressively away from the object and the seat forwardly relative to the chassis and the legrest from retracted to an extended position as transition is made from upright sitting position to a position of reclination responsively to an impelling force generated by the occupant upon the chassis in one direction with a resultant reaction of the seat relative to the chassis in the same direction.

* * * * *

Disclaimer 3,941,417.—*Frank M. Ré*, Holyoke, Mass. RECLINING CHAIR. Patent dated Mar. 2, 1976. Disclaimer filed July 19, 1978, by the assignee, *Dual Manufacturing and Engineering, Incorporated.*

The term of this patent subsequent to Sept. 11, 1990, has been disclaimed.

[*Official Gazette August 22, 1978.*]